US007314583B2

(12) United States Patent
Mori

(10) Patent No.: US 7,314,583 B2
(45) Date of Patent: Jan. 1, 2008

(54) ORGANIC POSITIVE TEMPERATURE COEFFICIENT THERMISTOR DEVICE

(75) Inventor: Yukie Mori, Tokyo (JP)

(73) Assignee: TDK Corporation, Tokyo (JP)

( * ) Notice: Subject to any disclaimer, the term of this patent is extended or adjusted under 35 U.S.C. 154(b) by 25 days.

(21) Appl. No.: 10/531,478

(22) PCT Filed: Mar. 25, 2004

(86) PCT No.: PCT/JP2004/004197

§ 371 (c)(1),
(2), (4) Date: Apr. 15, 2005

(87) PCT Pub. No.: WO2004/086421

PCT Pub. Date: Oct. 7, 2004

(65) Prior Publication Data

US 2006/0097231 A1 May 11, 2006

(30) Foreign Application Priority Data

Mar. 25, 2003 (JP) ..... 2003-083638

(51) Int. Cl.

| | |
|---|---|
| ***H01B 1/12*** | (2006.01) |
| ***H01B 1/00*** | (2006.01) |
| ***H01B 1/02*** | (2006.01) |
| ***H01C 7/10*** | (2006.01) |

(52) U.S. Cl. ..... 252/519.33; 252/500; 252/512; 338/22 R

(58) Field of Classification Search ..... 252/500, 252/512, 519.33; 338/22 R, 34
See application file for complete search history.

(56) References Cited

U.S. PATENT DOCUMENTS

| | | | | |
|---|---|---|---|---|
| 3,243,753 A | | 3/1966 | Kohler | |
| 3,351,882 A | | 11/1967 | Kohler et al. | |
| 4,545,926 A | * | 10/1985 | Fouts et al. | 252/511 |
| 4,966,729 A | | 10/1990 | Carmona et al. | |
| 5,250,228 A | * | 10/1993 | Baigrie et al. | 252/511 |
| 6,191,681 B1 | * | 2/2001 | Cole et al. | 338/22 R |
| 6,299,801 B1 | * | 10/2001 | Handa et al. | 252/511 |
| 6,362,722 B1 | * | 3/2002 | Cole et al. | 338/22 R |
| 6,375,867 B1 | * | 4/2002 | Smith et al. | 252/511 |

(Continued)

FOREIGN PATENT DOCUMENTS

EP 0 896 344 A2 2/1999

(Continued)

OTHER PUBLICATIONS

Strumpler, "Polymer Composite Thermistors for Temperature and Current Sensors," J. Appl. Phys., vol. 80, No. 11, pp. 6091-6096, Dec. 1, 1996.

(Continued)

*Primary Examiner*—Mark Kopec
*Assistant Examiner*—Jaison Thomas
(74) *Attorney, Agent, or Firm*—Oliff & Berridge, PLC

(57) ABSTRACT

An organic positive temperature coefficient thermistor device comprising a pair of electrodes disposed so as to oppose each other, and a thermistor body having a positive resistance-temperature characteristic disposed between the electrodes, wherein the thermistor body is constituted by a cured product of a mixture containing an epoxy resin including a flexible epoxy resin, a curing agent, and an electrically conductive particle.

6 Claims, 1 Drawing Sheet

U.S. PATENT DOCUMENTS 6,452,476 B1 * 9/2002 Handa ..... 338/22 R
6,459,358 B1 * 10/2002 Shea et al. ..... 338/20

FOREIGN PATENT DOCUMENTS

JP A 5-198403 8/1993
JP A 5-198404 8/1993
JP A 6-89802 3/1994
JP A 11-337419 12/1999
JP 2000-200704 7/2000
JP 2000-200704 A 7/2000
JP 2000-223303 8/2000
JP 2000-223303 A 8/2000
JP A 2000-223304 8/2000

OTHER PUBLICATIONS

European Search Report dated Jun. 11, 2007.
Japanese Office Action, Jul. 24, 2007.

* cited by examiner

ORGANIC POSITIVE TEMPERATURE COEFFICIENT THERMISTOR DEVICE

TECHNICAL FIELD

The present invention relates to an organic positive temperature coefficient thermistor device which is used in a temperature sensor or a heating or overcurrent protector device, for example, and has a PTC (Positive Temperature Coefficient) characteristic in which the resistance value increases as temperature rises.

BACKGROUND ART

An organic positive temperature coefficient thermistor device comprises a resistive element (thermistor body) in which conductive particles are dispersed in a polymer organic compound, and a pair of opposing electrodes disposed so as to hold the resistive element therebetween. A current is caused to flow between the pair of electrodes, whereby the thermistor device is utilized as an overcurrent/overheating protector device, a self-regulated heater, or a temperature sensor.

Organic positive temperature coefficient thermistor devices have been required to exhibit characteristics of a low room-temperature resistance value, a high resistance change ratio, and a high reliability in resistance value reproducibility or the like. As organic positive temperature coefficient thermistor devices responding to such a request, those using a crystalline polymer as a polymer organic compound are disclosed in U.S. Pat. Nos. 3,243,753 and 3,351,882. Also, an organic positive temperature coefficient thermistor device using a heat-curable resin is disclosed in U.S. Pat. No. 4,966,729.

Further, organic positive temperature coefficient thermistor devices using a conductive particle having spiky projections as a conductive particle are disclosed in Japanese Patent Application Laid-Open Nos. 5-198403 and 5-198404. Also, an organic positive temperature coefficient thermistor device using conductive short fibers is disclosed in Japanese Patent Application Laid-Open No. 5-198404.

Further, Japanese Patent Application Laid-Open No. HEI 5-198404 states that using a metal powder having spiky projections or flaky metal powder as a conductive particle and mixing therewith a low molecular alcohol or amine having at least three functional groups as a polymer organic compound can yield a low room-temperature resistance value and a large resistance change ratio. It further discloses that an organic positive temperature coefficient thermistor devices having such a high resistance value reproducibility that the change in room-temperature resistance value is small after heating and cooling is obtained.

As electronic devices have recently been becoming smaller, organic positive temperature coefficient thermistor devices have further been required to reduce their sizes. The organic positive temperature coefficient thermistor devices have been made smaller mainly by reducing their dimensions in electrode surface directions, i.e., by decreasing their electrode area.

DISCLOSURE OF THE INVENTION

When the electrode area of a conventional organic positive temperature coefficient thermistor device is made smaller, however, the room-temperature resistance value tends to increase. Also, the percentage of the thermistor body in contact with the outside air increases, so that the modification of the thermistor body is accelerated, whereby the reliability drastically decreases. When the thermistor device is exposed to a heat cycle environment or thermal shock environment in particular, the modification of the polymer organic compound contained in the thermistor body is accelerated, so that the room-temperature resistance value fails to restore its original value, thus remarkably lowering the resistance value reproducibility.

The following two methods are used for lowering the room-temperature resistance. The first method is achieved by reducing the distance between the electrodes. The second method is achieved by increasing the ratio of conductive particles in the thermistor body.

However, these two methods have been problematic in that the resistance change ratio of the organic positive temperature coefficient thermistor device decreases because of the following respective reasons.

The first method lowers the resistance in the whole temperature range of the thermistor body. The resistance of the organic positive temperature coefficient thermistor device is the sum of the resistance of the thermistor body and the contact resistance between the electrodes and the thermistor body. Therefore, when the distance between the electrodes is reduced, the contact resistance between the electrodes and the thermistor body cannot be neglected at a low temperature, i.e., in a low resistance state. As a result, the resistance change ratio of the organic positive temperature coefficient thermistor device decreases. In the second method, on the other hand, the ratio of the polymer organic compound decreases, whereby the resistance change ratio is reduced.

For overcoming these problems, epoxy resins exhibiting high expansion and shrinkage ratios in response to heat have been in use as the polymer organic compound. However, when repeatedly expanded/shrunk by heating/cooling, conventional epoxy resins exhibiting a high expandability/shrinkability gradually change their resin structure, thereby lowering the expansion ratio or shrinkage ratio. In particular, there remarkably occurs a phenomenon of keeping an expanded state and failing to shrink. Therefore, the resistance value reproducibility has been problematic in organic positive temperature coefficient thermistor devices using epoxy resins exhibiting a high thermal expandability.

Hence, it is an object of the present invention to provide an organic positive temperature coefficient thermistor device which exhibits a high resistance value reproducibility while keeping a low room-temperature resistance value and high resistance change ratio.

For achieving the above-mentioned object, the organic positive temperature coefficient thermistor device of the present invention comprises a pair of electrodes disposed so as to oppose each other, and a thermistor body having a positive resistance-temperature characteristic disposed between the electrodes, wherein the thermistor body consists of a cured product of a mixture containing an epoxy resin including a flexible epoxy resin, a curing agent, and an electrically conductive particle.

The present invention can provide an organic positive temperature coefficient thermistor device which exhibits a high resistance value reproducibility while keeping a low room-temperature resistance value and a high resistance change ratio.

The flexible epoxy resin in the present invention refers to epoxy resins having a linear structure, rubber-modified epoxy resins, silicone-modified epoxy resins, epoxidized polyolefins, urethane-modified epoxy resins, polythiol-based epoxy resins, polyol-based epoxy resins, and epoxy resins having a polycarboxyl compound structure.

Preferably, the thermistor body in accordance with the present invention contains 3 to 100% by mass of the flexible epoxy resin based on the total mass of the epoxy resin. This allows the organic positive temperature coefficient thermistor devices of the present invention to improve the resistance value reproducibility greatly while keeping a low room-temperature resistance value and a large resistance change ratio.

The organic positive temperature coefficient thermistor device of the present invention may comprise a pair of electrodes disposed so as to oppose each other, and a thermistor body having a positive resistance-temperature characteristic disposed between the electrodes, the thermistor body consisting of a cured product of a mixture containing a flexible epoxy resin having a bending elasticity of 2700 MPa or less and an electrically conductive particle. The bending elasticity (MPa) in the present invention refers to a value measured in accordance with JIS K 6911. From the viewpoint of enhancing the effect of the present invention, it will be preferred if the bending elasticity is 2550 MPa or less.

Preferably, in the present invention, the electrically conductive particle has a surface provided with a protrusion. This allows the organic positive temperature coefficient thermistor device to keep a further lower room-temperature resistance value. Also, the center distance between particles becomes greater than in truly spherical electrically conductive particles, whereby a steeper PTC characteristic can be attained.

BEST MODES FOR CARRYING OUT THE INVENTION

Figure 1:
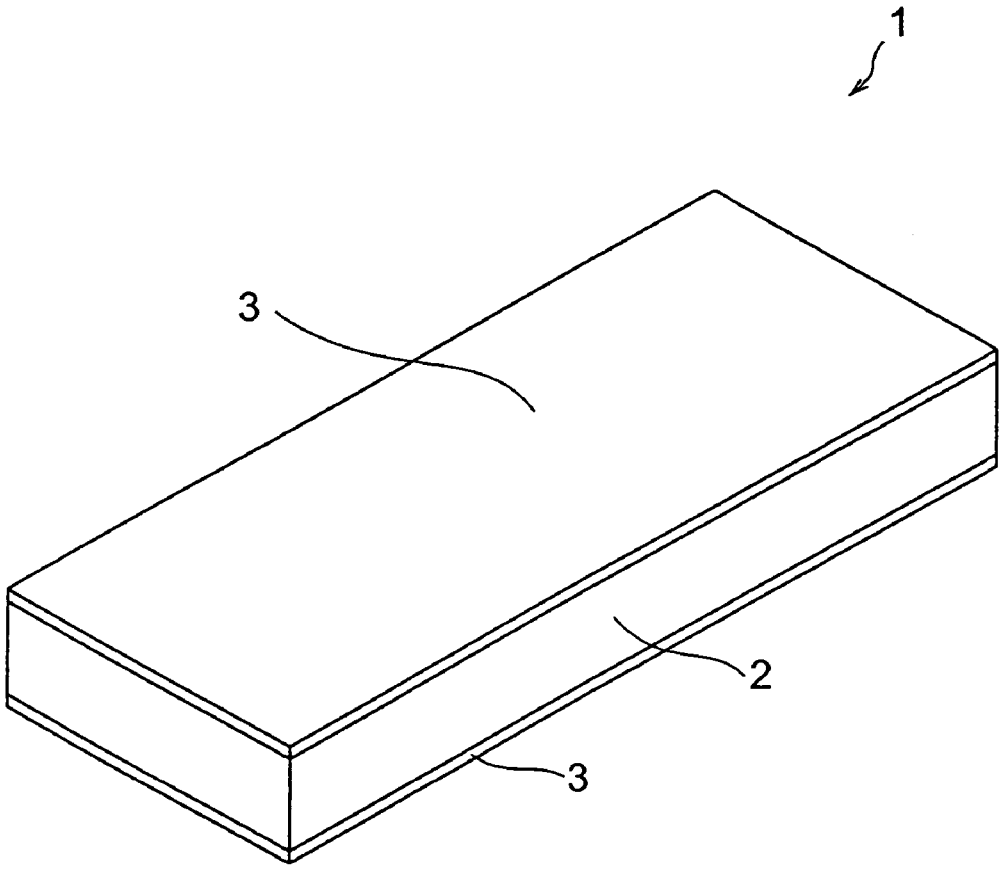
FIG. 1 is a schematic perspective view of an organic positive temperature coefficient thermistor device.

In the following, the organic positive temperature coefficient thermistor device of the present invention will be explained in detail with reference to the drawing. In the following explanation, parts identical or equivalent to each other will be referred to with numerals identical to each other without repeating their overlapping descriptions.

FIG. 1 is a perspective view schematically showing a preferred embodiment of the organic positive temperature coefficient thermistor device in accordance with the present invention.

The organic positive temperature coefficient thermistor device (hereinafter also referred to as "thermistor device" as the case may be) 1 shown in FIG. 1 is constituted by a pair of electrodes 3 disposed so as to oppose each other, and a thermistor body 2 having a positive resistance-temperature characteristic (hereinafter also referred to as "thermistor body" as the case may be) disposed between the electrodes 3. It may further comprise leads (not depicted) electrically connected to the electrodes 3 when necessary.

The form and material of the electrodes 3 are not restricted in particular as long as they have such an electronic conductivity as to function as an electrode of a thermistor device. The form and material of the leads are not restricted in particular as long as they have such an electronic conductivity as to release/inject electric charges from/into the electrodes 3 to/from the outside.

The thermistor body 2 is formed from a cured product of a mixture containing an epoxy resin including a flexible epoxy resin, a curing agent, and an electrically conductive particle.

Examples of the flexible epoxy resin include epoxy resins having a linear structure, rubber-modified epoxy resins, silicone-modified epoxy resins, epoxidized polyolefins, urethane-modified epoxy resins, polythiol-based epoxy resins, polyol-based epoxy resins, and epoxy resins obtained from polycarboxyl compounds as mentioned above.

Here, epoxy resins having a linear structure refer to epoxy resins having at least two epoxy groups (glycidyl ether groups) per molecule on average and any of divalent organic groups expressed by the following formulas (i) to (vi) in their skeletons, i.e., epoxy resins having any of the divalent organic groups expressed by the following formulas (i) to (vi) combined to glycidyl ether groups:

$$—[CH_2(CH_3)CH_2O]_n— \quad \text{(i)}$$

$$—[CH(CH_3)CH_2O]_n— \quad \text{(ii)}$$

$$—(CH_2)_n— \quad \text{(iii)}$$

$$—(CH_2CH_2O)_n— \quad \text{(iv)}$$

$$—CH_2C(C_2H_5)(CH_3)CH_2— \quad \text{(v)}$$

$$—[(CH_2)_mO]_n— \quad \text{(vi)}$$

In the above-mentioned formulas (i) to (vi), m is an integer of 1 to 20, and n is an integer of 1 to 20. When an epoxy resin includes the above-mentioned linear group in its skeleton, the epoxy resin can be provided with a flexibility. When such a flexible epoxy resin is contained in the thermistor body, the thermistor device can attain a desirable PCT characteristic.

An example of the rubber-modified epoxy resins is an epoxy resin having fine particles of liquid rubber dispersed therein. Examples of the liquid rubber include polybutylene (BR), polybutadiene (PBR), and butadiene/acrylonitrile (NBR) having a carboxyl group, hydroxyl group, or epoxy group at a terminal. The weight average molecular weight (Mw) of the liquid rubber is about 1000, for example. Here, Mw refers to the weight average molecular weight which is measured by gel permeation chromatography (GPC) based on the standard polystyrene.

Examples of the silicone-modified epoxy resins include epoxy resins containing fine particles of silicone rubber having a reactive group at a terminal, and epoxy resins having a siloxane bond (—Si—O—Si-bond) within a molecule. Examples of the fine particles of silicone rubber include those obtained by the methods set forth in the following 1) to 4).

1) Finely divided particles of a reaction product between (poly)dimethylsiloxane having an aminopropyl group at a terminal and an epoxy resin.
2) Finely divided particles of a reaction product between (poly)dimethylsiloxane having an epoxy group at a terminal and bisphenol A.
3) Using a dispersant as an oil droplet, silicone oil having a reactive group is dispersed in an epoxy resin and is crosslinked in the oil droplet, and this crosslinked product is finely divided into particles.
4) Finely divided particles of heat-curable silicone rubber dispersed in a novolac resin by using a surfactant.

An example of the urethane-modified epoxy resins is an epoxy resin having a urethane bond within a molecule. An example of this epoxy resin is a resin obtained when a urethane prepolymer obtained by a reaction between polyether polyol or polyester polyol and polyisocyanate is reacted with an epoxy resin having a hydroxyl group within a molecule.

An example of the epoxy resin having a polycarboxyl compound structure is a resin obtained by a reaction between a polycarboxylic acid such as a dimer acid and epichlorohydrin.

Preferred among them are rubber-modified epoxy resins, urethane-modified epoxy resins, and silicone-modified epoxy resins. The rubber-modified epoxy resins, urethane-modified epoxy resins, and silicone-modified epoxy resins enable a dehydrocondensation reaction between a hydroxyl group inherent in these modified resins and an epoxy group of an epoxy resin. As a consequence, these modified resins can form a chemical bond with an epoxy resin, and thus can reduce the change in room-temperature resistance value in intermittent load tests in particular.

Instead of the above-mentioned flexible resin, an epoxy resin having an alicyclic structure may be used for forming the thermistor body 2. An example of the epoxy resin having an alicyclic structure is an epoxy resin having a cyclohexane skeleton or cyclopentadiene sleketon, for example, and at least two epoxy groups per molecule on average as mentioned above.

It will be preferred if the content of the above-mentioned flexible epoxy resin and the epoxy resin having an alicyclic structure is 3 to 100 mass % based on the total mass of the epoxy resin. When the content of these resins is less than 3 mass %, the room-temperature resistance value and the resistance change ratio tend to decrease, and the resistance value reproducibility is less likely to become sufficient.

The thermistor body 2 may be formed by using a flexible epoxy resin preferably having a bending elasticity of 2700 MPs or less, more preferably 2550 MPa or less. Such a flexible epoxy resin is commercially available. Its examples include Rikaresin BPO20E, Rikaresin BPO60E, Rikaresin DME100, and Rikaresin DME200 (all being product names manufactured by New Japan Chemical Co., Ltd.); EP4000, EP4005, and EP4085 (all being product names manufactured by Asahi Denka Co., Ltd.); and YD-171, YD-716, YH-300, and PG202 (all being product names manufactured by Tohto Kasei Co., Ltd.).

The thermistor body 2 may include epoxy resins other than the flexible epoxy resin. The molecular weight, skeleton structure, etc. of the epoxy resins other than the flexible epoxy resin are not restricted in particular as long as they have at least two epoxy groups per molecule on average. Their examples include polyglycidyl ethers obtained when polyhydric phenols such as bisphenol A, bisphenol F, bisphenol AD, catechol, and resorcinol or polyhydric alcohols such as glycerin and polyethylene glycol are reacted with epichlorohydrin. Other examples include glycidyl ether esters obtained when hydroxycarboxylic acids such as p-hydroxybenzoic acid and β-hydroxynaphthoic acid are reacted with epichlorohydrin, and polyglycidyl esters obtained when polycarboxylic acids such as phthalic acid and terephthalic acid are reacted with epichlorohydrin. Still other examples include epoxidized phenol novolac resin, epoxidized cresol novolac resin, and dicyclopentadiene-based epoxy resin.

Curing agents used in general can be employed as the curing agent used for forming the thermistor body 2. Preferred among them are acid-anhydride-based agents which are more effective in lowering the initial resistance value than are amine-based curing agents. Examples of acid-anhydride-based curing agents include hexahydrophthalic anhydride, methylhexahydrophthalic anhydride, tetrahydrophthalic anhydride, methyltetrahydrophthalic anhydride, phthalic anhydride, succinic anhydride, trimellitic anhydride, pyromellitic dianhydride, methylnadic anhydride, maleic anhydride, benzophenonetetracarboxylic anhydride, ethylene glycol bistrimellitate, glycerol tris-trimellitate, endomethylenetetrahydrophthalic anhydride, methylendomethylenetetrahydrophthalic anhydride, methylbutenyltetrahydrophthalic anhydride, methylcyclohexenedicarboxylic anhydride alkylstyrene-maleic anhydride copolymer, chlorendic anhydride, tetrabromophthalic anhydride, polyazelaic anhydride, dodecenylsuccinic anhydride (DDSA), octenylsuccinic anhydride (OSA), pentadecenylsuccinic anhydride, and octylsuccinic anhydride.

Among them, using dodecenylsuccinic anhydride (DDSA), octenylsuccinic anhydride (OSA), pentadecenylsuccinic anhydride, and octylsuccinic anhydride can impart flexibility to the epoxy resin.

A curing accelerator may be added when forming the thermistor body 2. Adding the curing accelerator can lower the curing temperature and shorten the time required for curing at the time of manufacture. The curing accelerator is not restricted in particular, and its examples include tertiary amine, amine adduct compounds, imidazole adduct compounds, borate esters, Lewis acids, organic metal compounds, organic acid metal salts, and imidazoles.

For imparting flexibility to the epoxy resin, additives such as reactive diluents and plasticizers can be used in this embodiment. Examples of the reactive diluents include monoepoxide compounds. Examples of the monoepoxide compounds include n-butylglycidyl ether, allylglycidyl ether, 2-ethylhexylglycidyl ether, styrene oxide, phenylglycidyl ether, cresylglycidyl ether, p-sec-butylphenylglycidyl ether, glycidyl methacrylate, and tertiary carboxylic acid glycidyl ester. Examples of the plasticizers include polyhydric alcohols such as polyethylene glycol and propylene glycol.

The curing agent content is preferably 1:0.5 to 1:1.5, more preferably 1:0.8 to 1:1, in terms of the equivalent ratio with respect to the epoxy resin (epoxy resin:curing agent). When the curing agent content is less than 1:0.5, the curing reaction tends to become insufficient because of the lack of curing agents. When the curing agent content exceeds 1:1.5, on the other hand, unreacted curing agents tend to remain, thereby making it harder to yield a cured product of the epoxy resin having a desirable function.

Preferably, as the electrically conductive particle constituting the thermistor body 2, electrically conductive particles having a surface provided with projections are used. The projections preferably have spiky forms. When electrically conductive particles having spiky projections are used, it becomes easier for tunneling currents to flow between adjacent particles, whereby the room-temperature resistance value can be kept low. Further, the center distance between particles becomes greater than that between truly spherical electrically conductive particles, whereby a "steep" PTC characteristic can be attained. Also, as compared with the case using the fibrous conductive material disclosed in the above-mentioned Japanese Patent Application Laid-Open No. HEI 5-198404, the resistance value can be restrained from fluctuating.

From the viewpoint of conductivity, metals are preferred as a material for the electrically conductive particles. In particular, nickel metal is preferred because of chemical stability. In view of the miscibility with the polymer organic compound, temperature-resistance characteristic, and lower resistivity at a room-temperature condition, the particle diameter of the electrically conductive particles is preferably 0.5 to 4 μm. The resistance change ratio decreases when the particle diameter is less than 0.5 μm, whereas the electrically conductive particles lower their dispersibility or the room-temperature resistance increases when the particle diameter exceeds 4 μm, both being unsuitable in practice.

The electrically conductive particle content is preferably 50 to 90 mass %, more preferably 60 to 80 mass %, with respect to the total mass of the mixture. When the electrically conductive particle content is less than 50 mass %, electrically conductive paths are harder to form, so that the resistance value tends to increase. When the content exceeds 90 mass %, on the other hand, electrically conductive paths are harder to break, so that changes in resistance at an operating temperature are harder to occur.

An example of the method of making an organic positive temperature coefficient thermistor device 1 will now be explained.

First, predetermined amounts of the epoxy resin, curing agent, and electrically conductive particles are mixed together optionally with additives such as a curing accelerator (mixing step). Examples of apparatus used in this mixing step include known ones such as various stirrers, dispersers, and mills. Though the mixing time is not limited in particular, 10 to 60 minutes of mixing can usually disperse the components.

When bubbles mingle with the mixture during mixing, it will be preferred if vacuum defoaming is carried out. For controlling the viscosity, typical organic solvents such as reactive diluents and alcohols may be used.

Subsequently, by a method such as screen printing, thus obtained mixture is applied onto a metal foil acting as an electrode. Further, another metal foil is disposed such that the mixture is held between the two metal foils and press-formed into a sheet. The mixture may be caused to flow into a space between metal foil electrodes such as those made of nickel, copper, or the like, so as to be formed into a sheet.

Next, thus obtained sheet is heated, so as to be cured (curing step).

The curing can be effected by heating for 30 to 300 minutes at 100° to 180° C. with an oven. The mixture may be solely formed into a sheet by doctor blading, screen printing, etc., cured, and then coated with an electrically conductive paste or the like, so as to form electrodes.

A thermistor device can be obtained by punching out thus obtained sheet-shaped cured product (into a rectangular piece of 3.6 mm×9 mm, for example) (punching step). Usual methods for punching out an organic positive temperature coefficient thermistor device can be used as the punching method without any restrictions in particular.

When necessary, leads may be connected to respective surfaces of the electrodes of the thermistor device obtained by the punching step. As the lead connecting method, those used in normal methods of making an organic positive temperature coefficient thermistor device can be used without any restrictions in particular.

EXAMPLES

In the following, preferred examples of the present invention will be explained in further detail, though the present invention is not limited thereto.

The organic positive temperature coefficient thermistor device in accordance with any of these examples comprises, at least, a pair of opposing electrodes 3 and a thermistor body 2 disposed therebetween as shown in FIG. 1. As an epoxy resin, a bisphenol A type product under the product name of EPICLON850 (having an epoxy equivalent weight of 190 g/eq and a bending elasticity of 2800 MPa manufactured by Dainippon Ink and Chemicals, Inc.) was used. As flexible epoxy resins, product name E4005 (having an epoxy equivalent amount of 510 g/eq, manufactured by Asahi Denka Co., Ltd.) and rubber-modified epoxy resins under the product names of EPR4023 (having an epoxy equivalent amount of 222 g/eq, manufactured by Asahi Denka Co., Ltd.) and EPR-21 (having an epoxy equivalent amount of 210 g/eq, manufactured by Asahi Denka Co., Ltd.) were used. Further employed were methyltetrahydrophthalic-anhydride-based product name B570 (having an acid anhydride equivalent weight of 168 g/eq, manufactured by Dainippon Ink and Chemicals, Inc.) as a curing agent and product name PN-40J (manufactured by Ajinomoto-Fine-Techno Co., Inc.) as a curing accelerator. Furthermore, filamentous nickel particles having spiky protrusions under the product name of Type 255 nickel powder (having an average particle diameter of 2.2 to 2.8 μm, an apparent density of 0.5 to 0.65 $g/cm^3$ and a specific surface area of 0.68 $m^2/g$, manufactured by Inco Ltd.) were used as electrically conductive particles.

A method of making an organic positive temperature coefficient thermistor device and a method of evaluating the same will be set forth in the following.

The epoxy resin including the flexible epoxy resins, the curing agent at an equivalent ratio of 1:1 with respect to the epoxy resin, and 1 mass % of the curing accelerator based on the mass of the epoxy resin were mixed together while being stirred with a stirrer, so as to produce a mixture. The electrically conductive particles were added to this mixture by 60 mass %, and the mixing with stirring was carried out again, so as to produce a material for a thermistor body.

This thermistor body material was applied onto an Ni foil, another Ni foil sheet was stacked on the material, and the resulting product was heated to 150° C., so as to yield a sheet-shaped cured product.

This sheet-shaped cured product was punched out into a rectangular piece of 3.6×9.0 mm, so as to produce the organic positive temperature coefficient thermistor device of each Example. The thickness of the thermistor body was minutely adjusted such that the initial room-temperature resistance value became 5 to 6 mΩ. Here, the thickness of the thermistor body was about 0.5 mm in each Example.

The resistance value of this organic positive temperature coefficient thermistor device was measured by a four-terminal method in order to eliminate errors in measurement caused by the contact resistance between an electrode and a measurement terminal. While monitoring the resistance value, the thermistor device was heated from room temperature (25° C.) to 180° C. at 2° C./min, and then was cooled to room temperature at 2° C./min, whereby a temperature-resistance curve was measured. From this measurement, the resistance value (initial resistance value) at a room-temperature state before heating and the resistance change ratio (the resistance value at 180° C. with respect to the initial resistance value) were calculated.

For evaluating the resistance value reproducibility, 5 cycles of intermittent loading, each cycle applying a load of 6V at 10 A to this device for 10 seconds and then leaving the device for 350 seconds without load, were carried out, and the room-temperature resistance value of the device after loading was measured.

Further, for reliability evaluation, the organic positive temperature coefficient thermistor device was left at a high temperature of about 200° C. and then taken out at room temperature, where the device was observed in terms of deformations. No deformations were seen at all in any of Examples and Comparative Examples.

Examples and Comparative Examples will now be explained in detail.

Table 1 shows detailed conditions and evaluation results of the organic positive temperature coefficient thermistor devices in accordance with Examples 1 to 12 and Comparative Examples (Co. Exam.) 1 to 7.

TABLE 1

| | Flexible epoxy resin (product name) | Other epoxy resin (product name) | Flexible epoxy resin composition (wt %) | Initial resistance value (mΩ) | Resistance change ratio (log 10) | Room-temperature resistance value after intermittent load test (mΩ) |
|---|---|---|---|---|---|---|
| Example 1 | EP4005 | — | 100 | 5.7 | 10 | 28 |
| Example 2 | EP4005 | EPICLON850 | 25 | 5.5 | 10 | 26 |
| Example 3 | EP4005 | EPICLON850 | 5.2 | 5.5 | 9 | 55 |
| Example 4 | EP4005 | EPICLON850 | 3 | 5.5 | 8 | 70 |
| Example 5 | EPR4023 | — | 100 | 5.5 | 10 | 35 |
| Example 6 | EPR4023 | EPICLON850 | 25 | 5.5 | 10 | 59 |
| Example 7 | EPR4023 | EPICLON850 | 5.2 | 5.4 | 10 | 83 |
| Example 8 | EPR4023 | EPICLON850 | 3 | 5.3 | 9 | 89 |
| Example 9 | EPR-21 | — | 100 | 5.6 | 10 | 33 |
| Example 10 | EPR-21 | EPICLON850 | 25 | 5.4 | 10 | 53 |
| Example 11 | EPR-21 | EPICLON850 | 5.2 | 5.5 | 10 | 53 |
| Example 12 | EPR-21 | EPICLON850 | 3 | 5.3 | 9 | 84 |
| Co. Exam. 1 | EP4005 | EPICLON850 | 2 | 5.7 | 9 | 379 |
| Co. Exam. 2 | EP4005 | EPICLON850 | 1 | 5.1 | 8 | 327 |
| Co. Exam. 3 | EPR4023 | EPICLON850 | 2 | 5.1 | 8 | 377 |
| Co. Exam. 4 | EPR4023 | EPICLON850 | 1 | 6.0 | 8 | 403 |
| Co. Exam. 5 | EPR-21 | EPICLON850 | 2 | 5.6 | 10 | 205 |
| Co. Exam. 6 | EPR-21 | EPICLON850 | 1 | 6.0 | 9 | 324 |
| Co. Exam. 7 | — | EPICLON850 | 0 | 5.8 | 9 | 595 |

Each of the organic positive temperature coefficient thermistor devices in accordance with Examples and Comparative Examples shown in Table 1 exhibited a resistance change ratio of $10^7$ or greater. On the other hand, the resistance value after the intermittent load test decreased as the flexible epoxy resin composition (mass) increased in all of the flexible epoxy resins. In particular, the difference in resistance value after the intermittent load test was remarkable between Examples 1 to 12 in which the flexible epoxy resin composition (mass) was at least 3 mass % and Comparative Examples 1 to 7 in which the flexible epoxy resin composition (mass) was 2 mass % or less. This proved that the resistance value reproducibility became higher when an epoxy resin was compounded with a flexible epoxy resin regardless of the species of flexible epoxy resin, and that its effect became remarkable when the composition was 3 mass % or greater.

Next, with the epoxy resin having no flexibility changed to product name EPICLON830 (having an epoxy equivalent weight of 172 g/eq, manufactured by Dainippon Ink and Chemicals, Inc.) and product name AER250 (having an epoxy equivalent weight of 185 g/eq, manufactured by Asahi Kasei Corporation), organic positive temperature coefficient thermistor devices of Examples 13 to 18 and Comparative Examples 8 to 13 were produced, and their characteristics were evaluated. Table 2 shows detailed conditions and evaluation results of the organic positive temperature coefficient thermistor devices in accordance with Examples 13 to 18 and Comparative Examples 8 to 13.

TABLE 2

| | Flexible epoxy resin (product name) | Other epoxy resin (product name) | Flexible epoxy resin composition (wt %) | Initial resistance value (mΩ) | Resistance change ratio (log 10) | Room-temperature resistance value after intermittent load test (mΩ) |
|---|---|---|---|---|---|---|
| Example 13 | EP4005 | EPICLON830 | 25 | 5.2 | 7 | 47 |
| Example 14 | EP4005 | EPICLON830 | 5.2 | 5.8 | 7 | 77 |
| Example 15 | EP4005 | EPICLON830 | 3 | 5.5 | 7 | 99 |
| Example 16 | EP4005 | AER250 | 25 | 5.3 | 8 | 56 |
| Example 17 | EP4005 | AER250 | 5.2 | 6.0 | 8 | 83 |
| Example 18 | EP4005 | AER250 | 3 | 5.1 | 7 | 81 |
| Co. Exam. 8 | EP4005 | EPICLON830 | 2 | 5.1 | 6 | 203 |
| Co. Exam. 9 | EP4005 | EPICLON830 | 1 | 5.4 | 6 | 191 |
| Co. Exam. 10 | — | EPICLON830 | 0 | 5.4 | 6 | 311 |
| Co. Exam. 11 | EP4005 | AER250 | 2 | 5.2 | 6 | 163 |
| Co. Exam. 12 | EP4005 | AER250 | 1 | 5.1 | 6 | 182 |
| Co. Exam. 13 | — | AER250 | 0 | 5.9 | 6 | 471 |

Each of Examples 13 to 18 exhibited a resistance change ratio of $10^7$ or greater. On the other hand, Comparative Examples 8 to 13 yielded a resistance change ratio of $10^6$, which was not sufficient. It is presumed that the resistance change ratio varies dependent on the thermal expandability of the epoxy resin, which is a main component of the polymer organic compound contained in the thermistor device, and increases because of the thermal expandability of the flexible epoxy resin as the flexible epoxy resin composition increases.

Further, in all the flexible epoxy resins, the resistance value after the intermittent load test decreased as the flexible epoxy resin composition (mass) increased. In particular, the difference in resistance value after the intermittent load test was remarkable between Examples 13 to 18 in which the flexible epoxy resin composition (mass) was at least 3 mass % and Comparative Examples 8 to 13 in which the flexible epoxy resin composition (mass) was 2 mass % or less. This proved that the resistance value reproducibility became higher when an epoxy resin was compounded with a flexible epoxy resin regardless of the species of flexible epoxy resin, and that its effect became remarkable when the composition was 3 mass % or greater.

It can easily be presumed from Examples 1 to 18 in the foregoing that the present invention can attain similar effects when using not only the epoxy resins listed in the above-mentioned Examples but also epoxy resins having flexible structures, e.g., linear structures such as:

$$—(CH_2(CH_3)CHO)_n—,$$

$$—(CH(CH_3)CH_2O)_n—,$$

$$—(CH_2)_n—,$$

$$—(CH_2CH_2O)_n—,$$

$$—CH_2C(C_2H_5)(CH_3)CH_2—, \text{ and}$$

$$—[(CH_2)_mO]_n—$$

within a molecule, rubber-modified epoxy resins, silicone-modified epoxy resins, epoxidized polyolefins, urethane-modified epoxy resins, polythiol-based epoxy resins, polyol-based epoxy resins, and epoxy resins having a polycarboxyl compound structure.

Further, it can easily be presumed that the organic positive temperature coefficient thermistor device of the present invention can yield similar effects when using not only epoxy resins but also polymer organic compounds having a flexibility.

Next, as an epoxy resin, a bisphenol A type resin under the product name of EPICLON850 (having an epoxy equivalent weight of 190 g/eq and a bending elasticity of 2800 MPa, manufactured by Dainippon Ink and Chemicals, Inc.) was used. Also, as epoxy resins having an alicyclic structure, product name E4080 (having an epoxy equivalent weight of 240 g/eq, manufactured by Asahi Denka Co., Ltd.), product name E4088S (having an epoxy equivalent weight of 240 g/eq, manufactured by Asahi Denka Co., Ltd.), and product name AK-601 (153 g/eg, manufactured by Nippon Kayaku Co., Ltd.) were used. Further, methyltetrahydrophthalic anhydride under the product name of B570 (having an acid anhydride equivalent weight of 168 g/eq, manufactured by Dainippon Ink and Chemicals, Inc.) was used as a curing agent, and product name PN-40J (manufactured by Ajinomoto-Fine-Techno Co., Inc.) was used as a curing accelerator. Furthermore, filamentous nickel particles having spiky protrusions under the product name of Type 255 nickel powder (having an average particle diameter of 2.2 to 2.8 μm, an apparent density of 0.5 to 0.65 g/cm$^3$, and a specific surface area of 0.68 m$^2$/g, manufactured by Inco Ltd.) were used as electrically conductive particles. Using their mixture, organic positive temperature coefficient thermistor devices in accordance with Examples 19 to 30 and Comparative Examples 14 to 19 were produced. Table 3 shows detailed conditions and evaluation results of the organic positive temperature coefficient thermistor devices in accordance with Examples 19 to 30 and Comparative Examples 14 to 19.

TABLE 3

| | Flexible epoxy resin (product name) | Other epoxy resin (product name) | Flexible epoxy resin composition (wt %) | Initial resistance value (mΩ) | Resistance change ratio (log 10) | Room-temperature resistance value after intermittent load test (mΩ) |
|---|---|---|---|---|---|---|
| Example 19 | E4080 | — | 100 | 6.0 | 10 | 87 |
| Example 20 | E4080 | EPICLON850 | 25 | 6.0 | 8 | 70 |
| Example 21 | E4080 | EPICLON850 | 5.2 | 5.5 | 8 | 82 |
| Example 22 | E4080 | EPICLON850 | 3 | 5.5 | 8 | 97 |
| Example 23 | E4088S | — | 100 | 5.1 | 9 | 30 |
| Example 24 | E4088S | EPICLON850 | 25 | 5.5 | 8 | 45 |
| Example 25 | E4088S | EPICLON850 | 5.2 | 5.8 | 8 | 89 |
| Example 26 | E4088S | EPICLON850 | 3 | 5.8 | 7 | 80 |
| Example 27 | AK-601 | — | 100 | 5.9 | 9 | 42 |
| Example 28 | AK-601 | EPICLON850 | 25 | 5.8 | 10 | 52 |
| Example 29 | AK-601 | EPICLON850 | 5.2 | 5.2 | 9 | 69 |
| Example 30 | AK-601 | EPICLON850 | 3 | 5.7 | 8 | 68 |
| Co. Exam. 14 | E4080 | EPICLON850 | 2 | 5.7 | 7 | 206 |
| Co. Exam. 15 | E4080 | EPICLON850 | 1 | 5.0 | 6 | 328 |
| Co. Exam. 16 | E4088S | EPICLON850 | 2 | 5.5 | 6 | 448 |
| Co. Exam. 17 | E4088S | EPICLON850 | 1 | 5.4 | 6 | 422 |
| Co. Exam. 18 | AK-601 | EPICLON850 | 2 | 5.3 | 6 | 398 |
| Co. Exam. 19 | AK-601 | EPICLON850 | 1 | 5.7 | 4 | 356 |

As shown in Table 3, each of the organic positive temperature coefficient thermistor devices in accordance with Examples 19 to 30 and Comparative Examples 14 to 19 exhibited a resistance change ratio of $10^7$ or greater. Further, in all the epoxy resins having an alicyclic structure, the resistance value after the intermittent load test decreased as the composition (mass) of epoxy resins having an alicyclic structure increased. In particular, the difference in resistance value after the intermittent load test was remarkable between Examples 19 to 30 in which the flexible epoxy resin composition (mass) was at least 3 mass % and Comparative Examples 14 to 30 in which the flexible epoxy resin composition (mass) was 2 mass % or less. This proved that the resistance value reproducibility became higher when an epoxy resin was compounded with an epoxy resin having an alicyclic structure regardless of the species of epoxy resin having an alicyclic structure, and that its effect became remarkable when the composition was 3 mass % or greater.

Though explained with reference to Examples in the foregoing, the present invention is not limited thereto but can be modified in various manners. For example, though the above-mentioned embodiment and examples use only PN-40J, which is a curing accelerator, as an auxiliary component, other components may further be added thereto.

INDUSTRIAL APPLICABILITY

As explained in the foregoing, the present invention can provide an organic positive temperature coefficient thermistor device which exhibits a high resistance value reproducibility while keeping a low room-temperature resistance value and high resistance change ratio.

The invention claimed is:

1. An organic positive temperature coefficient thermistor device comprising a pair of electrodes disposed so as to oppose each other, and a thermistor body having a positive resistance-temperature characteristic disposed between the electrodes, wherein the thermistor body consists of a cured product of a mixture containing a curing agent, an electrically conductive particle and an epoxy resin including a flexible epoxy resin selected from:

an epoxy resin having a linear structure that consists of any divalent organic group expressed by the following formula (v) combined to at least two glycidyl ether groups:

$$—CH_2C(C_2H_5)(CH_3)CH_2— \quad (v);$$

a rubber-modified epoxy resin, wherein fine particles of liquid rubber of polybutylene (BR) or butadiene/acrylonitrile (NBR) having a carboxyl group, hydroxyl group or epoxy group at a terminal, or polybutadiene (PBR) having a carboxyl group or hydroxyl group at a terminal, are dispersed; and a polythiol-based epoxy resin.

2. An organic positive temperature coefficient thermistor device according to claim 1, wherein the epoxy resin includes 3 to 100% by mass of the flexible epoxy resin based on the total mass of the epoxy resin.

3. An organic positive temperature coefficient thermistor device according to claim 1, wherein the thermistor body consists of a cured product of a mixture containing a flexible epoxy resin having a bending elasticity of 2700 MPa or less and an electrically conductive particle.

4. An organic positive temperature coefficient thermistor device according to claim 1, wherein the conductive particle has a surface provided with a protrusion.

5. An organic positive temperature coefficient thermistor device according to claim 2, wherein the conductive particle has a surface provided with a protrusion.

6. An organic positive temperature coefficient thermistor device according to claim 3, wherein the conductive particle has a surface provided with a protrusion.

* * * * *